US007857303B2

(12) United States Patent
Oomori et al.

(10) Patent No.: US 7,857,303 B2
(45) Date of Patent: Dec. 28, 2010

(54) SHEET FEEDING APPARATUS AND IMAGE FORMING APPARATUS

(75) Inventors: Akira Oomori, Numazu (JP); Masao Amano, Susono (JP); Eiichiro Kimizuka, Mishima (JP); Daisuke Aoki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/560,857

(22) Filed: Sep. 16, 2009

(65) Prior Publication Data

US 2010/0001458 A1 Jan. 7, 2010

Related U.S. Application Data

(62) Division of application No. 11/559,100, filed on Nov. 13, 2006, now Pat. No. 7,607,655.

(30) Foreign Application Priority Data

Dec. 26, 2005 (JP) ..... 2005-373556

(51) Int. Cl.
*B65H 3/06* (2006.01)

(52) U.S. Cl. ..... 271/117; 271/118

(58) Field of Classification Search ..... 271/117, 271/118, 121, 124, 167, 145, 162, 164
See application file for complete search history.

(56) References Cited

U.S. PATENT DOCUMENTS

| | | | | |
|---|---|---|---|---|
| 5,433,428 | A | 7/1995 | Akashi | 271/127 |
| 6,050,565 | A | 4/2000 | Fetherolf | 271/145 |
| 2004/0071486 | A1 | 4/2004 | Manabe et al. | 399/367 |
| 2005/0179192 | A1 | 8/2005 | Miura et al. | 271/118 |

*Primary Examiner*—Stefanos Karmis
*Assistant Examiner*—Jeremy Severson
(74) *Attorney, Agent, or Firm*—Fitzpatrick, Cella, Harper & Scinto

(57) ABSTRACT

An over-stack protective portion is provided on a stopper member. When a sheet feeding device is in a standby position, the over-stack protective portion is held in a position in which the over-stack protective portion is in pressure contact with sheets having the maximum stacking height capable of being fed and supported by a sheet supporting portion. Also, when the sheets are to be fed, the pressure contact of the over-stack protective portion with the sheets having the maximum stacking height is released.

10 Claims, 7 Drawing Sheets

SHEET FEEDING APPARATUS AND IMAGE FORMING APPARATUS

This is a divisional of U.S. patent application Ser. No. 11/559,100, filed Nov. 13, 2006, allowed Jun. 23, 2009.

BACKGROUND OF THE INVENTION

1. Field of the Invention

The present invention relates to a sheet feeding apparatus and an image forming apparatus and particularly to a construction to prevent over-stacking of sheets on a sheet supporting portion.

2. Description of the Related Art

Heretofore, in an image forming apparatus such as a printer and a copying machine, a sheet feeding apparatus is provided for feeding out a sheet to an image forming portion from a sheet supporting portion on which a plurality of sheets are stacked.

In the sheet feeding apparatus constructed as above, when more than a predetermined quantity of sheets are stacked on a sheet feed tray (hereinafter referred to as over-stacking of sheets), defective sheet feeding occurs.

Methods to prevent such over-stacking of sheets include a method of putting a mark indicating an upper limit of the sheet stacking height on a width regulating member arranged on the sheet feed tray, for example. FIG. 8A is a view showing a construction of a conventional sheet feeding apparatus, which employs this method. At a width regulating member 109 arranged on a sheet feed tray 101, a mark 109*a* indicating the upper limit of the sheet stacking height is provided. When a user sets a sheet bundle on the sheet feed tray, the user is supposed to visually check this mark 109*a* so as to prevent over-stacking of the sheets.

However, when the mark 109*a* indicating the upper limit of stacking is provided on the width regulating member 109 in this way, the user may not notice the mark 109*a* and causes an over-stacking state. In this case, feeding-out of sheets by a pickup roller (not shown) cannot be carried out reliably, and defective sheet feeding might occur.

In order to prevent such over-stacking without relying on visual check by the user of the upper-limit mark of sheet stacking, there is a method of providing a member for restricting a stacking height on the width regulating member. FIG. 8B shows a construction of a conventional sheet feeding apparatus, which employs this method, and a restricting member 109*b* for restricting the sheet stacking height is provided on the width regulating member 109.

When the user sets the sheet bundle on the sheet feed tray, the user is supposed to prevent over-stacking of the sheet by setting the sheet in a range not exceeding this restricting member 109*b* for the sheet stacking height.

However, in the conventional sheet feeding apparatus provided with the restricting member 109*b* for the sheet stacking height on the width regulating member in this way, when the sheet bundle is to be set on the sheet feed tray, the sheet bundle might be forced to be below the restricting member 109*b* and set thereon. In this case, the sheets which were forced in and set are held between the restricting member 109*b* and the sheet feed tray. Therefore, even if the sheet is to be fed by the pickup roller, sheet feed resistance is generated to prevent feeding-out and cause defective sheet feed.

SUMMARY OF THE INVENTION

The present invention has been made in view of such circumstances and an object thereof is to provide a sheet feeding apparatus and an image forming apparatus, which can prevent over-stacking without providing an over-stack protective member on a sheet supporting portion and can stably feed sheets with low costs.

The present invention provides a sheet feeding apparatus comprising: a sheet supporting portion configured to support sheets; a sheet feeding device swingable between a sheet feeding position for feeding out a sheet supported by the sheet supporting portion and a standby position spaced from the sheet supported by the sheet supporting portion; and an over-stack protective portion configured to restrict an insertion of the sheets higher than a maximum stacking height capable of being supported by the sheet supporting portion, wherein a movement of the over-stack protective portion is regulated to restrict sheet insertion when the sheet feeding device is in the standby position, and the over-stack protective portion is released from a regulation of the movement in association with swing motion of the sheet feeding device from the standby position to the sheet feeding position.

DESCRIPTION OF THE EMBODIMENTS

The preferred embodiments for carrying out the present invention will hereinafter be described in detail with reference to the drawings.

Figure 1:
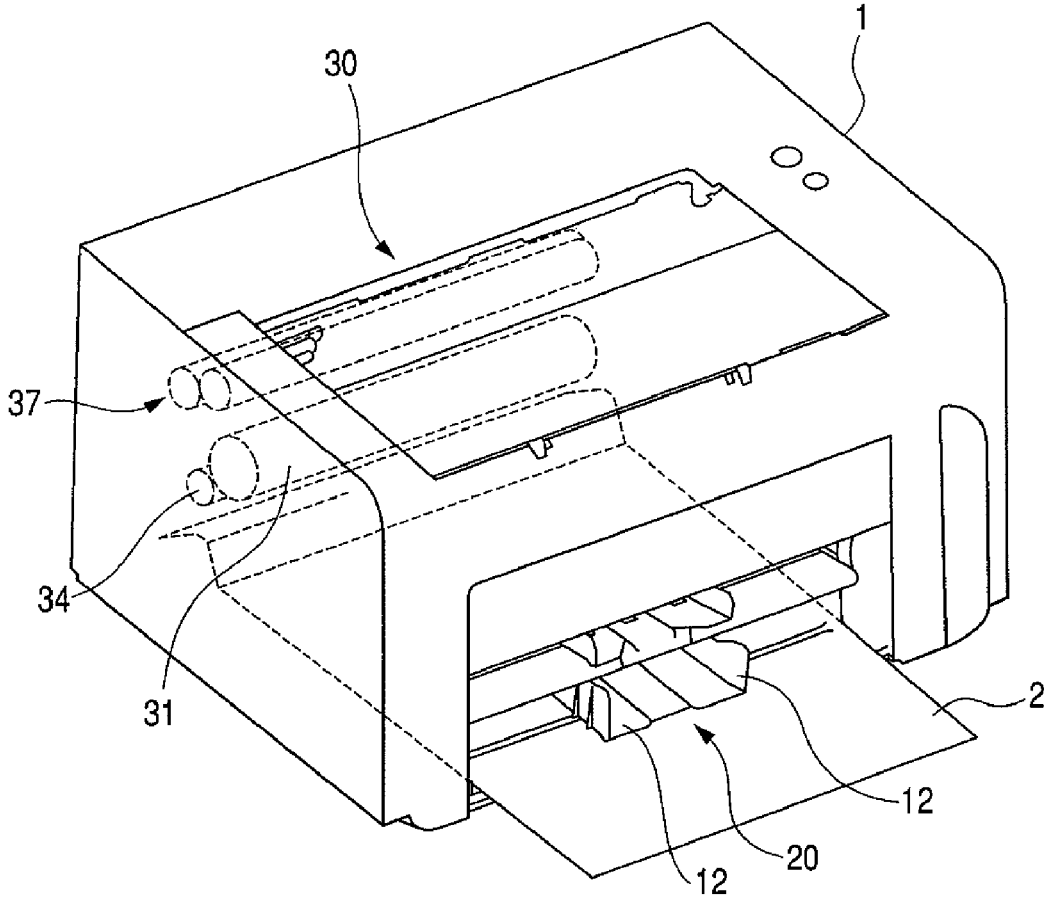
FIG. 1 is a perspective view of an image forming apparatus provided with a sheet feeding apparatus according to a first embodiment of the present invention.
Figure 8A:
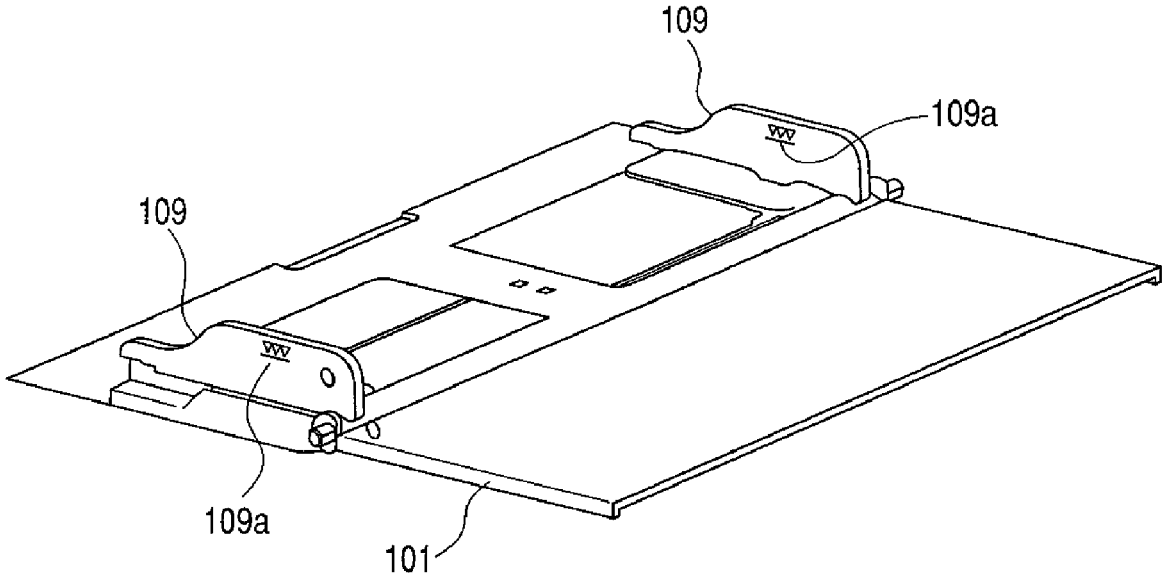
FIGS. 8A and 8B illustrate an over-stack protective portion of a conventional sheet feeding apparatus.
Figure 8B:
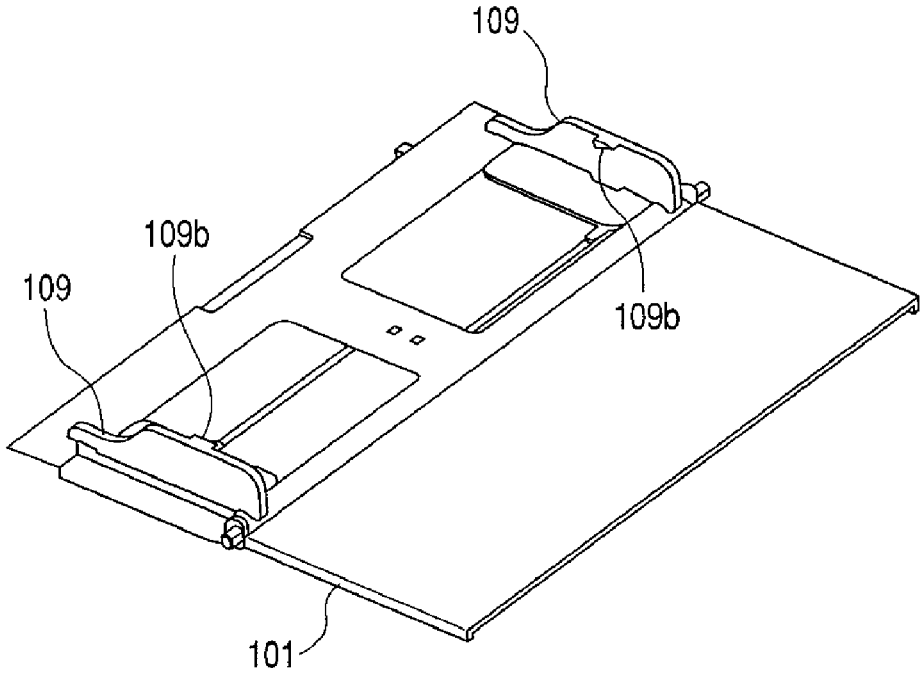

FIG. 1 is a perspective view of an image forming apparatus provided with a sheet feeding apparatus according to a first embodiment of the present invention. In FIG. 1, an image forming apparatus 1 is provided with an image forming portion 30 and a sheet feeding apparatus 20 for feeding a sheet to the image forming portion 30. The image forming portion 30 is comprised of a photosensitive drum 31, transfer roller 34 for transferring a toner image from the photosensitive drum 31 to the sheet S, and a fixing device 37 for fixing the toner image transferred by the transfer roller 34, etc. The sheet feeding apparatus 20 includes a sheet feed tray 2 as a sheet supporting portion on which a sheet bundle is set manually. A pair of width regulating members 12 is provided on the sheet feed tray 2 for regulating the position of the sheet in the width direction of the sheet to be stacked. A user manually sets the sheet bundle between this pair of width regulating members 12. In this embodiment, projections such as the above-mentioned restricting member 109*b* as shown in FIG. 8B are not provided on the width regulating members 12, so that the sheet setting ability of the embodiment is favorable.

Figure 2:
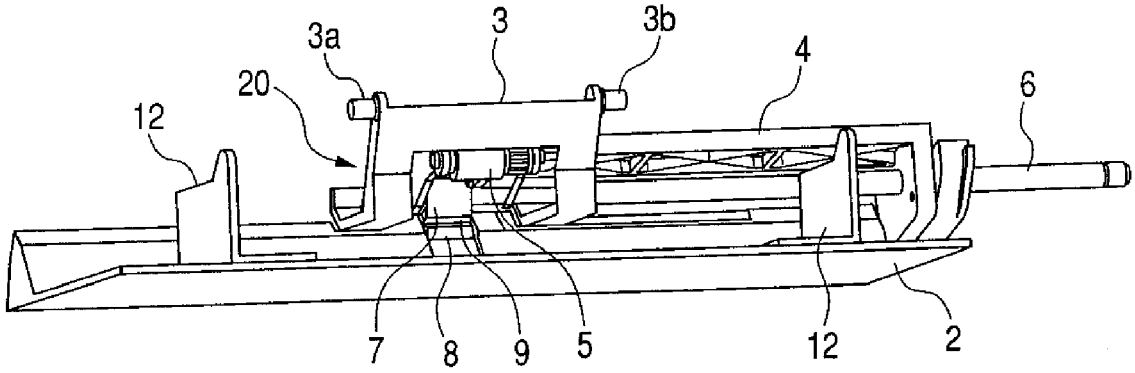
FIG. 2 is a view of the sheet feeding apparatus seen from the sheet set direction.
Figure 3:
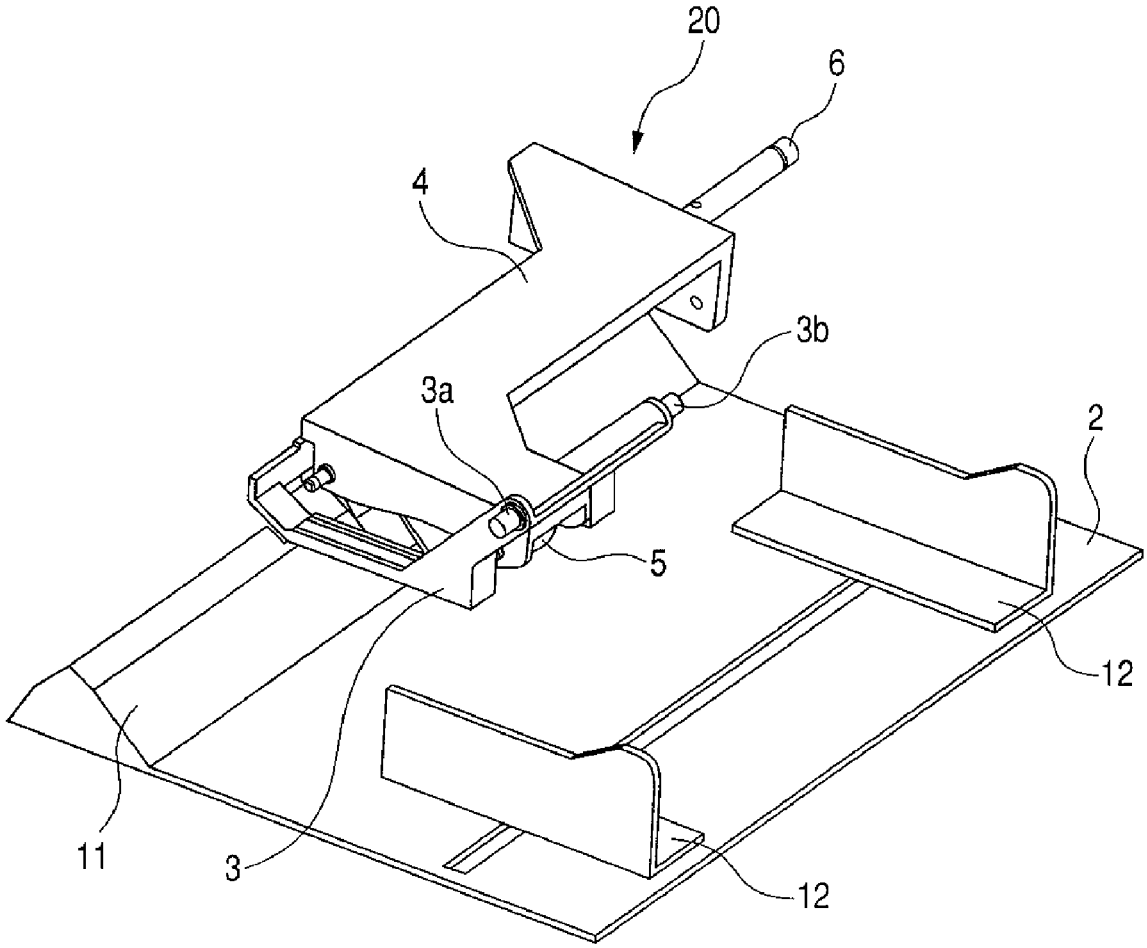
FIG. 3 is a perspective view of the sheet feeding apparatus.

FIG. 2 is a view of the sheet feeding apparatus 20 seen from the sheet set direction, FIG. 3 is a perspective view of the sheet feeding apparatus 20, and in FIGS. 2 and 3, a pickup roller 5 as a sheet feeding device feeds the sheet stacked on the sheet feed tray 2. This pickup roller 5 is provided above the sheet feed tray 2 for vertical movement as well as for movement between a sheet feeding position for abutting and feeding the sheet stacked on the sheet feed tray 2 and a standby position above the sheet feed tray 2.

A pick arm 4 as a holding portion for rotatably holding the pickup roller 5 is fixed to a feed roller shaft 6 provided at a main body (not shown) of a sheet feeding apparatus and made capable of pivotal movement in the vertical direction through this feed roller shaft 6.

This feed roller shaft 6 is rotated by a rotating mechanism (not shown) and the rotation of the feed roller shaft 6 rotates the pick arm 4 in the vertical direction. And with this pivotal movement of the pick arm 4, the pickup roller 5 moves between the sheet feeding position and the standby position.

The pickup roller 5 is held by the pick arm 4 in the standby position above the sheet feed tray 2 till a sheet feed operation is started. And when the sheet feed operation is started, the pickup roller 5 is rotated and moved to a position (sheet feeding position) abutting against the sheet stacked on the sheet feed tray 2 in association with a downward pivotal movement of the pick arm 4. Then, since the pickup roller 5 abuts against the sheet stacked on the sheet feed tray 2 while rotating, the sheet stacked on the sheet feed tray 2 is fed out.

A feed roller 7 is rotatably supported by the feed roller shaft 6. A pad arm 8 holds a separation pad 9 and is urged by an elastic member (not shown) toward the feed roller side. And the separation pad 9 is brought into pressure contact with the feed roller 7 by the pad arm 8 urged toward the feed roller side. In the sheet feeding apparatus 20 constructed in this way, when an image forming operation is started, the pick arm 4 is pivotally moved downward, and the pickup roller 5 abuts against the sheet stacked on the sheet feed tray 2 while rotating. Thereby, the sheets stacked on the sheet feed tray 2 are fed out and then, the fed-out sheets are separated by the feed roller 7 and the separation pad 9 one by one and conveyed to an image forming portion (not shown).

Since a separation mechanism of the sheet bundle by the feed roller 7 and the separation pad 9 is in a general construction, its description will be omitted. Next, after an image is formed in this image forming portion, the sheets are discharged to the outside of the image forming apparatus via a fixing process.

In FIGS. 2 and 3, a sheet stopper 3 is a stopper member for regulating the leading edge side of the sheet bundle supported on the sheet feed tray, and this sheet stopper 3 is supported for pivotal movement through shafts 3*a*, 3*b* by the main body (not shown) of the sheet feeding apparatus. Also, as shown in FIG. 3, an inclined surface portion 11 for guiding the sheet to a nip between the feed roller 7 and the separation pad 9 is formed on the end on the downstream side in the sheet feeding direction of the sheet feed tray 2.

Figure 4A:
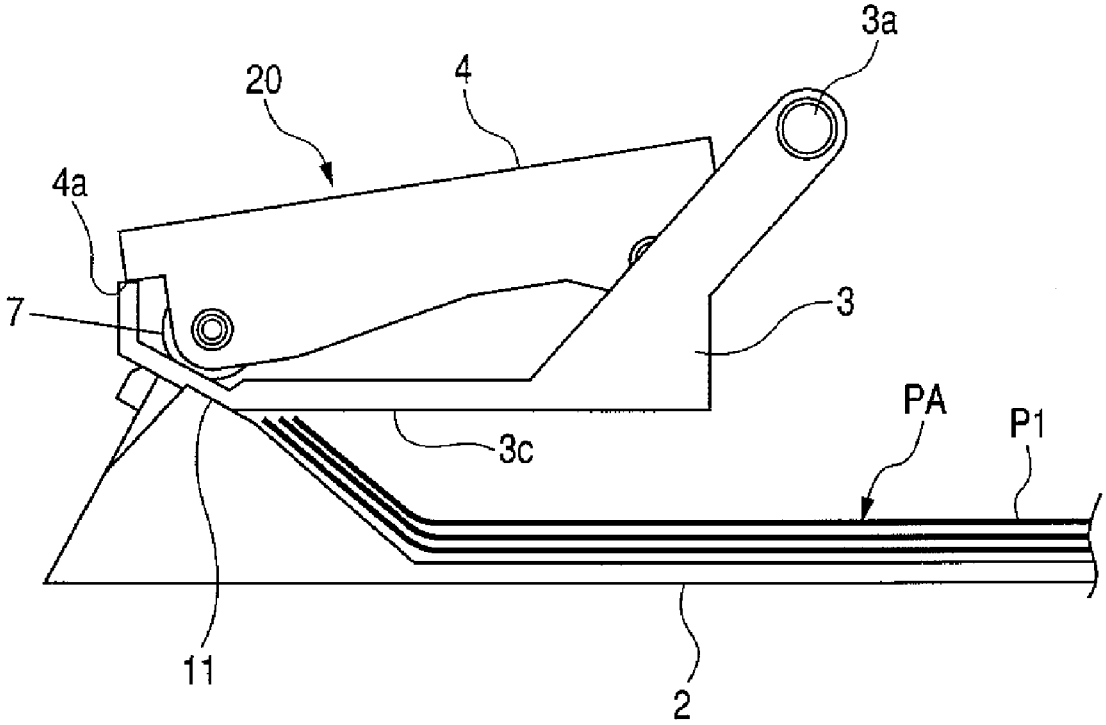
FIGS. 4A and 4B show a state during sheet feeding of the sheet feeding apparatus.

Here, when the user is to set a sheet bundle PA onto the sheet feed tray 2, the pick arm 4 swings so that the pickup roller 5 comes to the standby position as shown in FIG. 4A. At this time, the sheet stopper 3 pivots about the shaft 3*a* (3*b*) by the gravity of the sheet stopper 3 and abuts against the inclined surface portion 11. Thereby, the sheet stopper 3 is brought into a state in which the sheet stopper 3 cannot be pivotally moved downward (counterclockwise direction).

Moreover, an upper part of the rotating end of the sheet stopper 3 is restrained by a restraining portion 4*a* provided on the end on the downstream side of the pick arm 4 at this time, and thereby, the sheet stopper 3 cannot be pivotally moved upward (clockwise direction). In this way, since the sheet stopper 3 is restrained from being pivotally moved in the vertical direction, the leading edge of the sheet bundle can be surely restricted on the upstream side of the feed roller 7 by a bottom surface 3*c* of the sheet stopper 3 when the user inserts the sheet bundle PA into the sheet feed tray 2. Thereby, the sheet bundle is not forced into the nip portion between the feed roller 7 and the separation pad 9. As a result, occurrence of defective separation can be avoided.

Figure 4B:
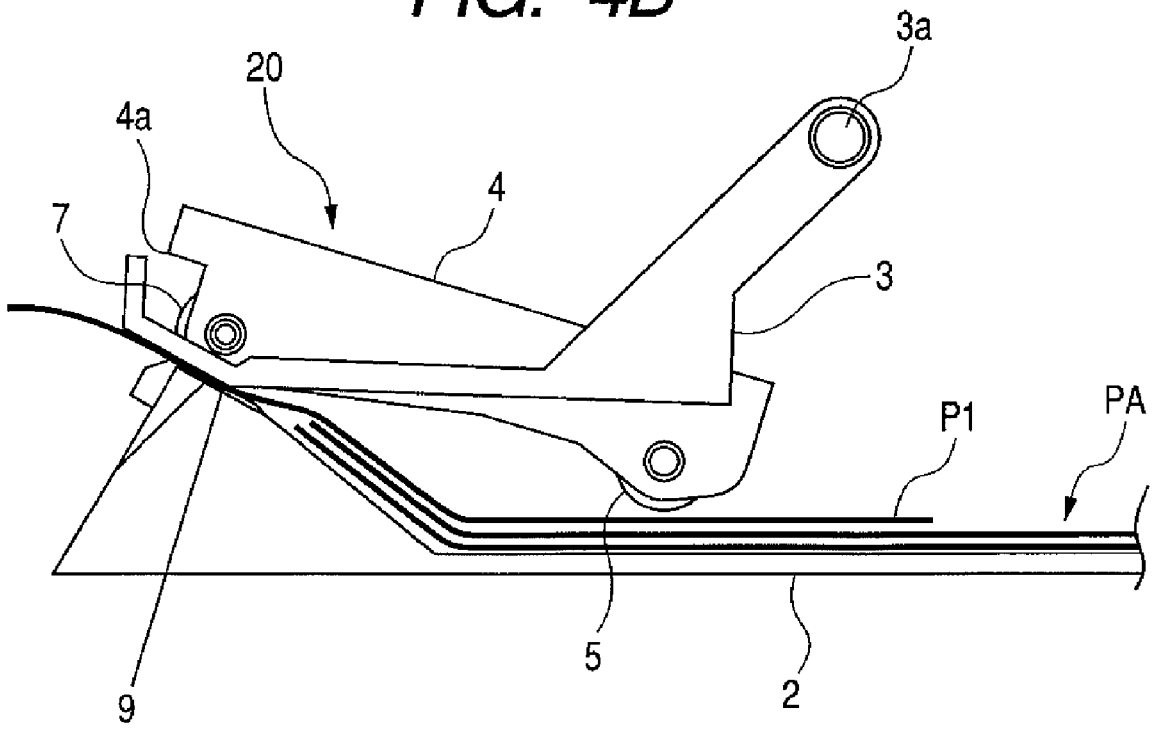

On the other hand, in the sheet feeding state, the pick arm 4 is pivotally moved downward as shown in FIG. 4B, and with that movement, the pickup roller 5 abuts against the uppermost sheet P1 of the sheet bundle PA on the sheet feed tray 2 while rotating so as to feed the uppermost sheet P1.

Here, when the pick arm 4 is pivotally moved downward in this way, the restraining portion 4*a* of the pick arm 4 having been restrained by the sheet stopper 3 is separated from the sheet stopper 3 and releases regulation on the pivotal movement by the sheet stopper 3. That is, the sheet stopper 3 is held in the regulating position for regulating the leading edge of the sheet P when the pickup roller 5 is in the standby position, while regulation on the sheet leading edge is released when the pickup roller 5 is in the sheet feeding position.

Thereby, thereafter, when the sheet P1 is fed by the pickup roller 5, the sheet stopper 3 is pushed up by the fed-out sheet P1. Then, thereafter, the sheet P1 which pushed up the sheet stopper 3 is fed to the image forming portion through a separation portion comprised of the feed roller 7 and the separation pad 9.

Next, the construction to prevent over-stacking of the sheets on the sheet feed tray 2 in the sheet feeding apparatus 20 provided with the sheet stopper 3 constructed as above will be described.

Figure 5:
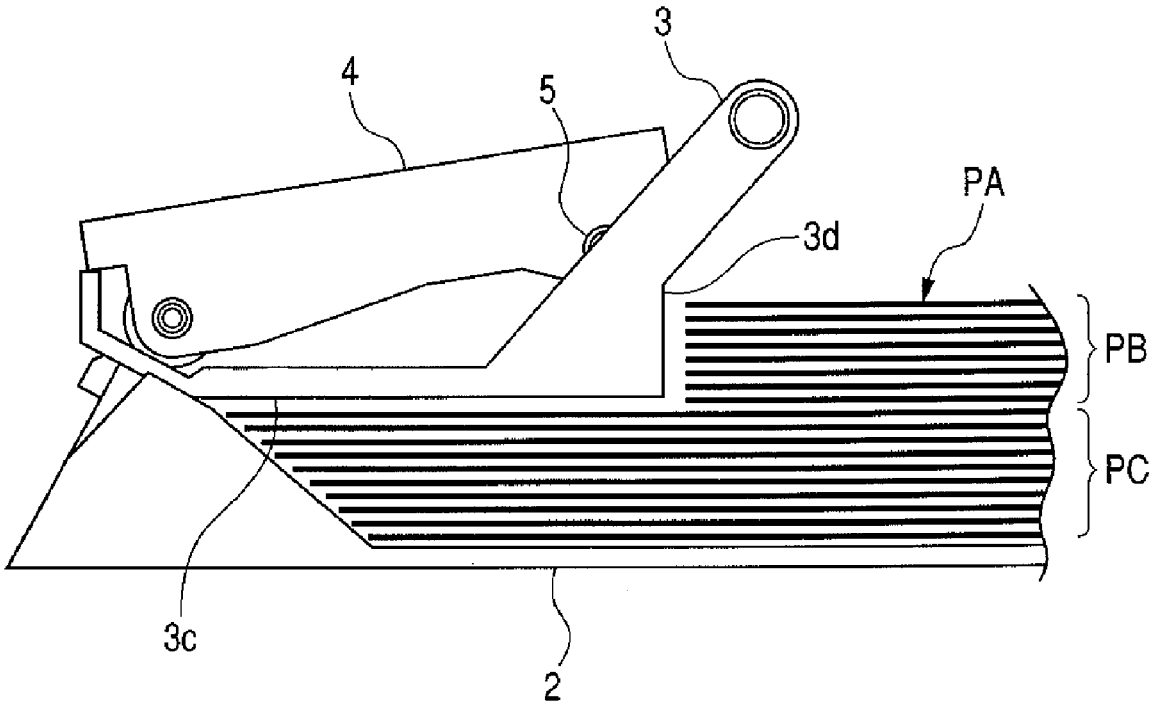
FIG. 5 illustrates an over-stack protective portion of the sheet feeding apparatus.

FIG. 5 is a diagram showing a state where the user sets the sheet bundle having a height more than the maximum stacking height capable of being fed into the sheet feed tray 2.

In FIG. 5, an over-stack protective wall 3*d* is provided on the sheet stopper 3 and formed upward substantially at a right angle from the end on the upstream side in the sheet feeding direction of the bottom surface 3*c* of the sheet stopper 3. By providing this over-stack protective wall 3*d*, if the sheet bundle PA exceeding the maximum stacking height capable of being fed is to be inserted into the sheet feed tray 2 manually, sheets PB of the portion exceeding the maximum stacking height abuts against the over-stacking protective wall 3*d*, which is the over-stack regulating portion. Thereby, sheets PC having the maximum stacking height capable of being fed are pushed in between the bottom surface 3*c* of the sheet stopper 3 and the sheet feed tray 2.

Here, till the feeding operation is started, as mentioned above, since the sheet stopper 3 cannot be pivotally moved upward by being regulated by the pick arm 4, the leading edge of the sheet can be surely regulated. Moreover, since the over-stack protective wall 3*d* is arranged on the upstream side with respect to the pickup roller 5, the sheets PB exceeding the maximum stacking height cannot be inserted below the pickup roller 5, and defective feeding or the like cannot be occur.

Figure 6A:
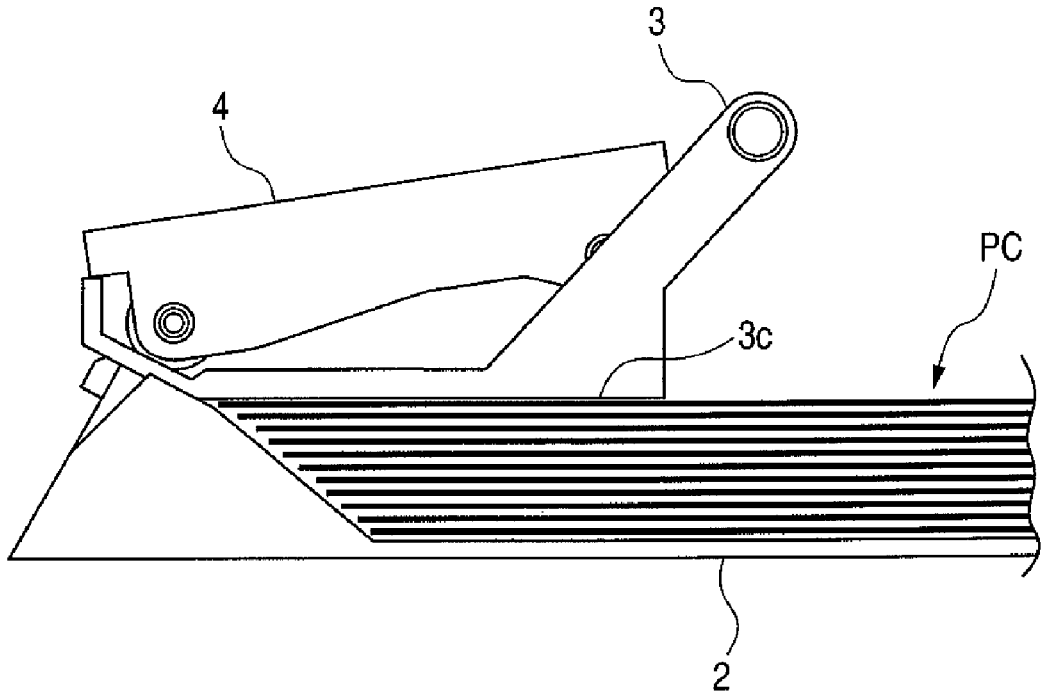
FIGS. 6A and 6B illustrate an operation of the over-stack protective portion of the sheet feeding apparatus.

Also, when the sheet stopper 3 is in the regulating position as shown in FIG. 6A, if the sheets are further forced in a state in which the sheet feed tray 2 is fully loaded with the sheet bundle PC having the maximum stacking height, the sheets PC are brought into pressure contact with the bottom surface 3*c* of the sheet stopper 3 constituting the over-stack protective portion. That is, the sheet bundle is nipped between the bottom surface 3*c* of the sheet stopper 3 and the sheet feed tray 2.

Figure 6B:
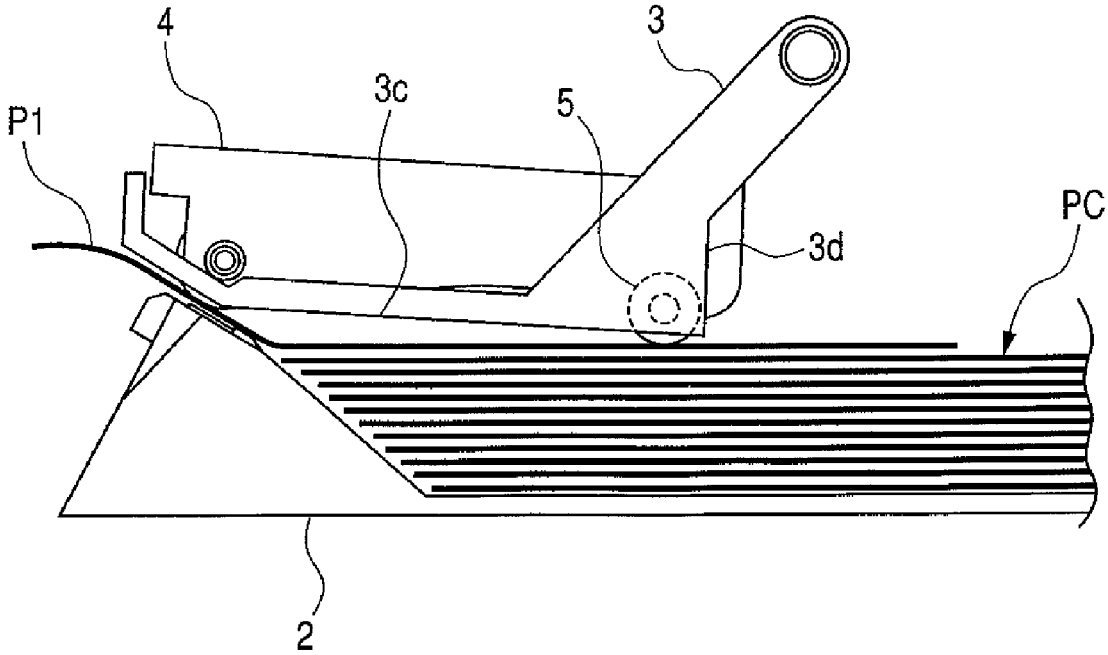

However, when the pickup roller 5 is moved to the sheet feeding position as shown in FIG. 6B, the sheet stopper 3 becomes capable of pivotal movement as mentioned above, so as to be capable of being pushed up by the fed sheet P1. Thereby, the pressure contact of the bottom surface 3*c* of the sheet stopper 3 with the sheet is released or substantially weakened, and the bottom surface 3*c* of the sheet stopper 3 becomes resistance and prevents defective sheet feeding. In this way, even if the bottom surface 3*c* of the sheet stopper 3 is brought into the pressure contact with the sheet bundle when the pickup roller 5 is in the standby position, the pressure contact with the sheet bundle is released or weakened when the sheet is to be fed, and therefore reliable sheet feeding is realized.

According to this embodiment, since a mechanism for preventing over-stacking of the sheets is provided integrally with the sheet stopper 3, the over-stacking of the sheets can be prevented without providing an over-stack protective member on the sheet feed tray 2, and the sheets can be fed stably with low costs. Moreover, reduction of the number of parts and space can be promoted, and over-stacking of the sheets can be surely prevented without relying on visual check by the user of the sheet stacking upper-limit mark.

Next, a second embodiment of the present invention will be described.

Figure 7:
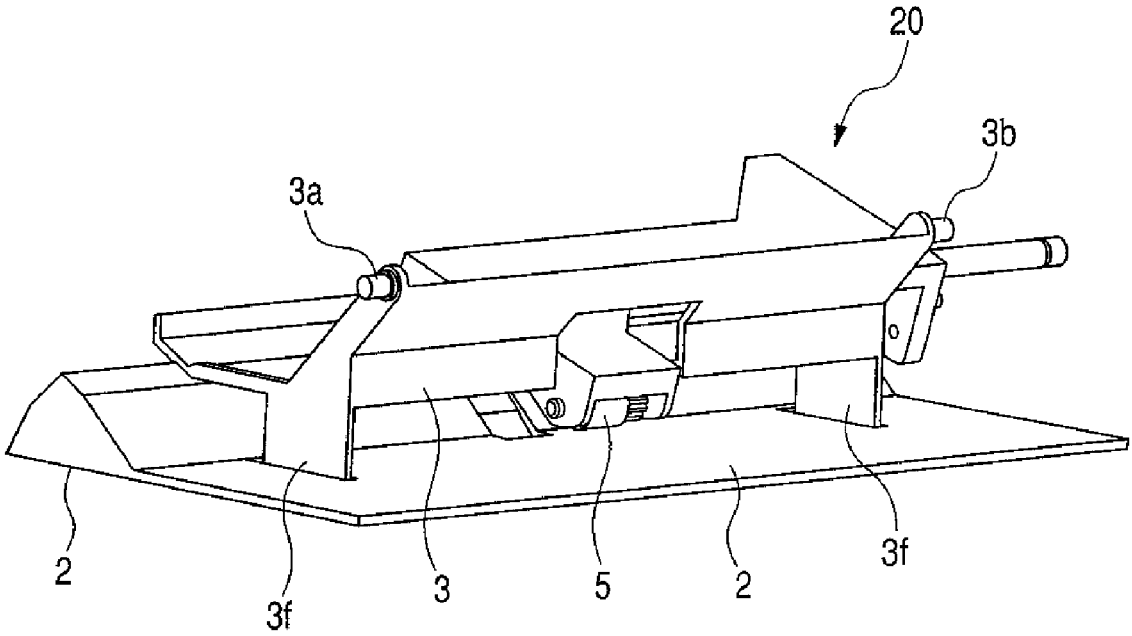
FIG. 7 is a perspective view of a sheet feeding apparatus according to a second embodiment of the present invention.

FIG. 7 is a perspective view of the sheet feeding apparatus according to the present invention. In FIG. 7, the same reference numerals as those in FIG. 2 indicate the same or corresponding portions and the description will be omitted.

In FIG. 7, width regulating members 3*f* are provided on the sheet stopper 3. By providing the width regulating members 3*f* on the sheet stopper 3 in this way, the sheet stopper 3 can regulate not only the sheet-bundle leading edge and the stacking height but also a position of the sheet in the sheet width direction.

By regulating the position of the sheet in the sheet width direction as well as the sheet bundle leading edge and the stacking height, not only the accurate positioning of the sheet leading edge portion and the prevention of over-stacking but also the skew feed of the sheet in a feeding operation can be prevented by regulation in the sheet width direction. By preventing the skew feed of the sheets in this way, image positions can be accurately aligned with the sheets, and the image formation is achieved with accuracy.

Heretofore, the sheet feeding apparatus having a manual feed tray was described as an example of the sheet feeding apparatus, but the present invention can be also applied to the sheet feeding apparatus of a general image reading apparatus such as an ADF (Automatic Document Feeder).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-373556, filed Dec. 26, 2005 which is hereby incorporated by reference herein in its entirety.

What is claimed is:

1. A sheet feeding apparatus comprising:

a sheet supporting portion configured to support sheets;

a sheet feeding device movable between a sheet feeding state for feeding the sheets supported on said sheet supporting portion and a standby position spaced from the sheets supported by said sheet supporting portion and configured to feed the sheets supported on the sheet supporting portion at the sheet feeding state;

an over-stack protective portion provided upstream of said sheet feeding device in the sheet feeding direction and configured to restrict a manual insertion of a plurality of sheets higher than a maximum stacking height capable of being supported by said sheet supporting portion; and a stopper member provided downstream of the over-stack protective portion in the sheet feeding direction and configured to regulate a leading edge of the manual insertion sheets inserted between the sheet supporting portion and the over-stack protective portion, wherein the stopper member releases a regulation of the sheet leading edge while the sheet feeding device feeds the sheets, and wherein a movement of said over-stack protective portion is regulated to restrict the insertion of sheets when said sheet feeding device is in said standby position, and said over-stack protective portion is released from a regulation of the movement in association with a movement of said sheet feeding device from the standby position to the sheet feeding state.

2. A sheet feeding apparatus according to claim 1, wherein said over-stack protective portion is provided on said stopper member so that, when said sheet feeding device is in the standby position, a movement of said stopper member to regulate the sheet leading edge by the stopper member is regulated and the insertion of the sheets by said over-stack protective portion is restricted, and when said sheet feeding device is in the sheet feeding state, the regulation on the sheet leading edge by said stopper member and the regulation on the movement of said over-stack protective portion are released.

3. A sheet feeding apparatus according to claim 2, further comprising:

a holding portion configured to move said sheet feeding device between the sheet feeding position and the standby state position, wherein when said sheet feeding device is moved to the standby position, said holding portion abuts against said stopper member to hold said stopper member in a regulation position, while when said sheet feeding device is moved to the sheet feeding state, an abutment of said holding portion against said stopper member is released.

4. A sheet feeding apparatus according to claim 2, wherein said over-stack protective portion comprises a parallel portion of said stopper member in parallel with said sheet supporting portion when said stopper member is in a regulation position.

5. A sheet feeding apparatus according to claim 4, wherein said stopper member is extended upward from an upstream side end in a sheet feeding direction of said parallel portion and is provided with an over-stack regulating portion abutting against sheets of a portion exceeding the maximum stacking height of the sheets supported by said sheet supporting portion.

6. An image forming apparatus comprising:

a sheet supporting portion configured to support sheets;

a sheet feeding device movable between a sheet feeding state position for feeding the sheets supported on said sheet supporting portion and a standby position spaced from the sheets supported by said sheet supporting portion and configured to feed the sheets supported on the sheet supporting portion at the sheet feeding state;

an over-stack protective portion provided upstream of said sheet feeding device in the sheet feeding direction and configured to restrict a manual insertion of a plurality of sheets higher than a maximum stacking height capable of being supported by said sheet supporting portion; and a stopper member provided downstream of the over-stock protective portion in the sheet feeding direction and configured to regulate a leading edge of the manual insertion sheets inserted between the sheet supporting portion and the over-stack protective portion, wherein the stopper member releases a regulation of the sheet leading edge while the sheet feeding device feeds the sheets, an image forming portion configured to form an image on the sheet fed out by said sheet feeding device, wherein a movement of said over-stack protective portion is regulated to restrict the insertion of sheets when said sheet feeding device is in said standby position, and said over-stack protective portion is released from a regulation of the movement in association with a movement of said sheet feeding device from the standby position to the sheet feeding state.

7. An image forming apparatus according to claim 6, wherein said over-stack protective portion is provided on said stopper member so that, when said sheet feeding device is in the standby position, a movement of said stopper member to regulate the sheet leading edge by the stopper member is regulated and the insertion of the sheets by said over-stack protective portion is restricted, and when said sheet feeding device is in the sheet feeding state, the regulation on the sheet leading edge by said stopper member and the regulation on the movement of said over-stack protective portion are released.

8. An image forming apparatus according to claim 6, further comprising:

a holding portion configured to move said sheet feeding device between the sheet feeding state and the standby position, wherein when said sheet feeding device is moved to the standby position, said holding portion abuts against said stopper member to hold said stopper member in a regulation position, while when said sheet feeding device is moved to the sheet feeding state, an abutment of said holding portion against said stopper member is released.

9. An image forming apparatus according to claim 6, wherein said over-stack protective portion comprises a parallel portion of said stopper member in parallel with said sheet supporting portion when said stopper member is in a regulation position.

10. An image forming apparatus according to claim 9, wherein said stopper member is extended upward from an upstream side end in a sheet feeding direction of said parallel portion and is provided with an over-stack regulating portion abutting against sheets of a portion exceeding the maximum stacking height of the sheets supported by said sheet supporting portion.

* * * * *